US009452506B2

(12) United States Patent
Butterfield et al.

(10) Patent No.: US 9,452,506 B2
(45) Date of Patent: Sep. 27, 2016

(54) VACUUM CLEANING SYSTEMS FOR POLISHING PADS, AND RELATED METHODS

(71) Applicant: Applied Materials, Inc., Santa Clara, CA (US)

(72) Inventors: Paul D. Butterfield, San Jose, CA (US); Shou-Sung Chang, Redwood City, CA (US); Bum Jick Kim, Palo Alto, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 39 days.

(21) Appl. No.: 14/530,163

(22) Filed: Oct. 31, 2014

(65) Prior Publication Data

US 2016/0016283 A1 Jan. 21, 2016

Related U.S. Application Data

(60) Provisional application No. 62/024,951, filed on Jul. 15, 2014.

(51) Int. Cl.
*B24B 53/00* (2006.01)
*B24B 53/017* (2012.01)

(52) U.S. Cl.
CPC ..... *B24B 53/017* (2013.01)

(58) Field of Classification Search
CPC ..... B24B 53/017; B24B 53/12; B24B 37/04; B24B 57/02; B24B 37/042
USPC ..... 451/56, 72, 443, 444, 449
See application file for complete search history.

(56) References Cited

U.S. PATENT DOCUMENTS 5,885,137 A * 3/1999 Ploessl ..... B24B 37/04 451/443
6,099,393 A * 8/2000 Katagiri ..... B24B 53/013 451/444
6,626,743 B1 * 9/2003 Boyd ..... B24B 21/04 451/138
7,040,967 B2 * 5/2006 Benner ..... B24B 53/017 134/2
7,597,608 B2 * 10/2009 Chang ..... B24B 53/12 451/443
2002/0090896 A1 7/2002 Li et al.
2003/0082997 A1 * 5/2003 Jensen ..... B24B 21/04 451/41
2004/0241989 A1 * 12/2004 Benner ..... B24B 53/00 438/689
2005/0164606 A1 * 7/2005 Benner ..... B24B 49/18 451/5
2007/0042691 A1 * 2/2007 Kim ..... B24B 53/017 451/444
2007/0087672 A1 * 4/2007 Benner ..... B24B 53/017 451/56
2011/0143640 A1 6/2011 Bajaj
2014/0273763 A1 9/2014 Lee et al.

(Continued)

*Primary Examiner* — George Nguyen
(74) *Attorney, Agent, or Firm* — Patterson & Sheridan, LLP

(57) ABSTRACT

Vacuum cleaning systems and related methods are disclosed. A polishing pad in combination with a fluid, such as a slurry, contacts a substrate to planarize material at the surface thereof and resultantly creates debris. A cleaning system includes an enclosure body having an inlet opening which may be placed proximate to the polishing pad and an exit opening in communication with a vacuum source to remove the debris and the fluid from the polishing pad through a passageway connecting the inlet and exit openings. By including contact members secured to the enclosure body and configured to form an abutment against a working surface of the polishing pad, a Venturi effect zone between the enclosure body and the working surface of the polishing pad may be created to dislodge fluid and debris from the working surface. In this manner, scratches and contamination are avoided for later-polished substrates.

20 Claims, 7 Drawing Sheets

(56) References Cited

U.S. PATENT DOCUMENTS

2014/0323017 A1 10/2014 Tang et al.

2016/0016283 A1* 1/2016 Butterfield ..... B24B 53/017
451/56

* cited by examiner

VACUUM CLEANING SYSTEMS FOR POLISHING PADS, AND RELATED METHODS

CROSS-REFERENCE TO RELATED APPLICATION

This application claims the benefit of U.S. Provisional Application Ser. No. 62/024,951 entitled "Vacuum Cleaning Systems For Polishing Pads Employing Enclosure Bodies and Containment Walls, and Related Methods," and filed Jul. 15, 2014, which is incorporated herein by reference in its entirety.

BACKGROUND

1. Field

Embodiments of the present disclosure generally relate to creating planar surfaces on substrates and on layers formed on substrates, and specifically to chemical-mechanical polishing (CMP).

2. Description of the Related Art

In the fabrication of integrated circuits and other electronic devices, multiple layers of conducting, semiconducting, and dielectric materials are deposited on or removed from a surface of a wafer substrate, such as a semiconductor substrate or a glass substrate. As layers of materials are sequentially deposited on and removed from the substrate, the uppermost surface of the substrate may become non-planar and require planarization before further lithographic patterning can be patterned thereon. Planarizing a surface, or "polishing" a surface, is a process where material is removed from substrate surface to form a generally even, planar substrate surface. Planarization is useful in removing undesired surface topography and surface defects, such as rough surfaces, agglomerated materials, crystal lattice damage, scratches, and contaminated layers or materials. Planarization is also useful in forming features on a substrate by removing excess material which has been deposited to fill the features, and to provide an even surface for subsequent lithography-based patterning steps.

Chemical mechanical planarization, or chemical mechanical polishing (CMP), is a common technique for planarizing substrates. CMP utilizes a fluid chemical composition, typically mixed with an abrasive to form a slurry, for selective removal of material from the surface of a substrate. In conventional CMP techniques, a substrate carrier or polishing head is mounted on a carrier assembly to position a substrate secured therein in contact with a polishing pad in a CMP apparatus. The substrate carrier provides a controllable pressure to the substrate urging the substrate against the polishing pad. The polishing pad is moved relative to the substrate by an external driving force. Thus, the CMP apparatus creates polishing or rubbing movement between the surface of the substrate and the polishing pad while dispersing a fluid polishing composition, or slurry, to effect both chemical activity and mechanical activity. The polishing pad has a precise shape to distribute the fluid and contact the substrate. The polishing pad may be cleaned to remove debris which would otherwise collect upon the polishing pad and cause damage to substrates processed therewith and reduce the polishing pad life.

In some cases, fluid may comprise ten-nanometer sized abrasive particles comprised of metal oxides, for example, silica ($SiO_2$), alumina ($Al_2O_3$), cerium oxide ($CeO_2$), and titanium oxide ($TiO_2$) suspended in an aqueous solution, such as potassium hydroxide (KOH). Other fluid compositions are possible. As part of the polishing process, debris generated from the working surface of the substrate enters the fluid and also collects on the polishing pad. This debris can cause various issues that can in some issues be problematic, such as creating scratches on the substrate surface and contamination of later-polished substrates. Thus, the contaminated fluid and the debris collected on the polishing pad need to be dislodged from and removed from the polishing pad. Dislodgement and removal of debris and/or contaminated fluid may occur before, during, and/or after polishing depending upon the requirements of the substrate being polished. Current methods of removal have included water rinsing and vacuum using high-energy liquid or gas flows to disengage the fluid and/or debris from the polishing pad. Once disengaged, the challenge becomes to remove the fluid and/or debris without backwash and/or spray-back to the polishing pad which can be issues with current approaches. What are needed are new approaches to disengage and remove fluid and/or debris from the polishing pad without backwash or spray-back to the polishing pad.

SUMMARY

Embodiments disclosed herein include vacuum cleaning systems for polishing pads and related methods. A polishing pad in combination with a fluid, such as a slurry, contacts a substrate to planarize material at the surface thereof and resultantly creates debris. A cleaning system includes an enclosure body having an inlet opening which may be placed proximate to the polishing pad and an exit opening in communication with a vacuum source to remove the debris and the fluid from the polishing pad through a passageway connecting the inlet and exit openings. By including contact members secured to the enclosure body and configured to form an abutment against a working surface of the polishing pad, a Venturi effect zone between the enclosure body and the working surface of the polishing pad may be created to dislodge fluid and debris from the working surface. In this manner, scratches and contamination are avoided for later-polished substrates.

In one embodiment, a cleaning system for a polishing pad is disclosed. The cleaning system includes an enclosure body including an inlet opening, an exit opening, and an inner volume. The cleaning system also includes a plurality of contact members secured to the enclosure body and configured to form an abutment against a working surface of the polishing pad, and configured to position the inlet opening a predetermined distance from the working surface of the polishing pad. The cleaning system further includes a vacuum source in communication with the exit opening of the outer enclosure body. In this manner, the debris and fluid may be removed from the polishing pad to reduce an opportunity to cause defects in later-polished substrates.

In another embodiment, a method is disclosed. The method includes disposing an enclosure body of a cleaning system at a predetermined position relative to a working surface of a polishing pad. The enclosure body includes an inlet opening, an exit opening, and an inner volume. The method includes positioning the inlet opening a predetermined distance from the working surface of the polishing pad by forming an abutment between the polishing pad and a plurality of contact members secured to the enclosure body. The method also includes creating, with a vacuum source, a Venturi effect zone between the inlet opening and the working surface of the polishing pad to dislodge fluid and debris from the working surface and to entrain the fluid and the debris into the airflow. The method also includes passing the fluid and the debris entrained within the airflow through the enclosure body. In this manner, the debris may be efficiently removed from the polishing pad and a probability of backflow of the debris and the fluid onto the polishing pad may be reduced.

In another embodiment, a chemical-mechanical polishing (CMP) system is disclosed. The CMP system includes a polishing pad secured to a rotatable platen. The CMP system also includes a polishing head arranged to position a surface of a substrate against the polishing pad. The CMP system also includes a cleaning system for the polishing pad. The cleaning system includes an enclosure body including an inlet opening, an exit opening, and an inner volume. The cleaning system also includes a plurality of contact members secured to the enclosure body and configured to form an abutment against a working surface of the polishing pad, and configured to position the inlet opening a predetermined distance from the working surface of the polishing pad. The cleaning system further includes a vacuum source in communication with the exit opening of the outer enclosure body. In this manner, substrates may avoid scratches and contamination from fluid and debris associated with previously-polished substrates.

Additional features and advantages will be set forth in the detailed description which follows, and in part will be readily apparent to those skilled in the art from that description or recognized by practicing the embodiments as described herein, including the detailed description that follows, the claims, as well as the appended drawings.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIGS. 4A through 4C are schematic views of an abutment being created between the polishing pad and the cleaning system of FIG. 1A, wherein FIG. 4A depicts no abutment, FIG. 4B depicts an abutment between a first contact member and the polishing pad, and FIG. 4C depicts an abutment between the first and second contact members and the polishing pad.

To facilitate understanding, identical reference numerals have been used, where possible, to designate identical elements that are common to the figures. It is contemplated that elements and features of one embodiment may be beneficially incorporated in other embodiments without further recitation

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein. Whenever possible, like reference numbers will be used to refer to like components or parts.

Embodiments disclosed herein include vacuum cleaning systems for polishing pads and related methods. A polishing pad in combination with a fluid, such as a slurry, contacts a substrate to planarize material at the surface thereof and resultantly creates debris. A cleaning system includes an enclosure body having an inlet opening which may be placed proximate to the polishing pad and an exit opening in communication with a vacuum source to remove the debris and the fluid from the polishing pad through a passageway connecting the inlet and exit openings. By including contact members secured to the enclosure body and configured to form an abutment against a working surface of the polishing pad, a Venturi effect zone between the enclosure body and the working surface of the polishing pad may be created to dislodge fluid and debris from the working surface. In this manner, scratches and contamination are avoided for later-polished substrates.

Figure 1A:
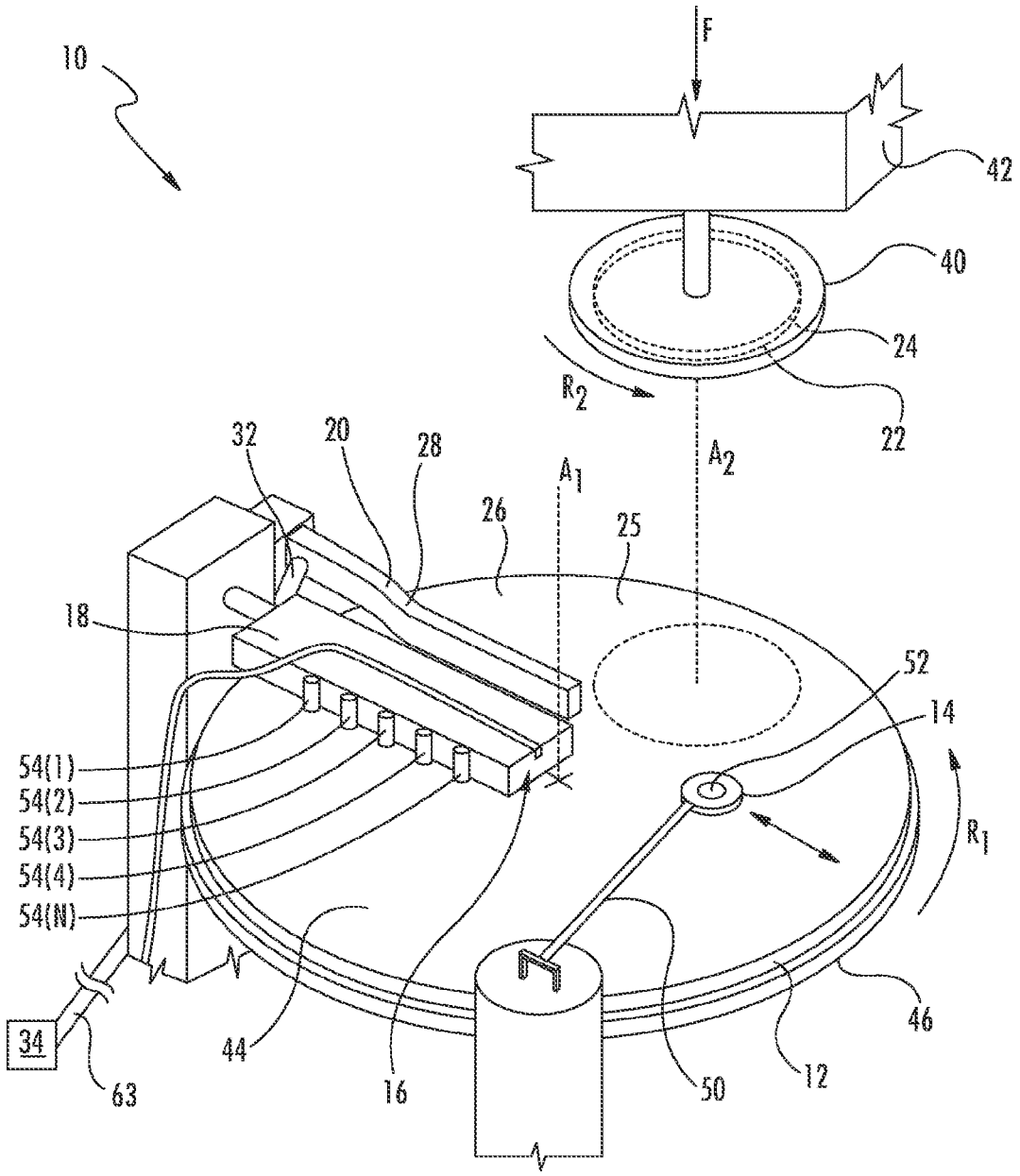
FIGS. 1A and 1B are a top perspective view and a schematic top plan view, respectively, of an exemplary chemical-mechanical polishing (CMP) system employing an exemplary cleaning system to remove debris and fluid from a polishing pad of the CMP system.
Figure 1B:
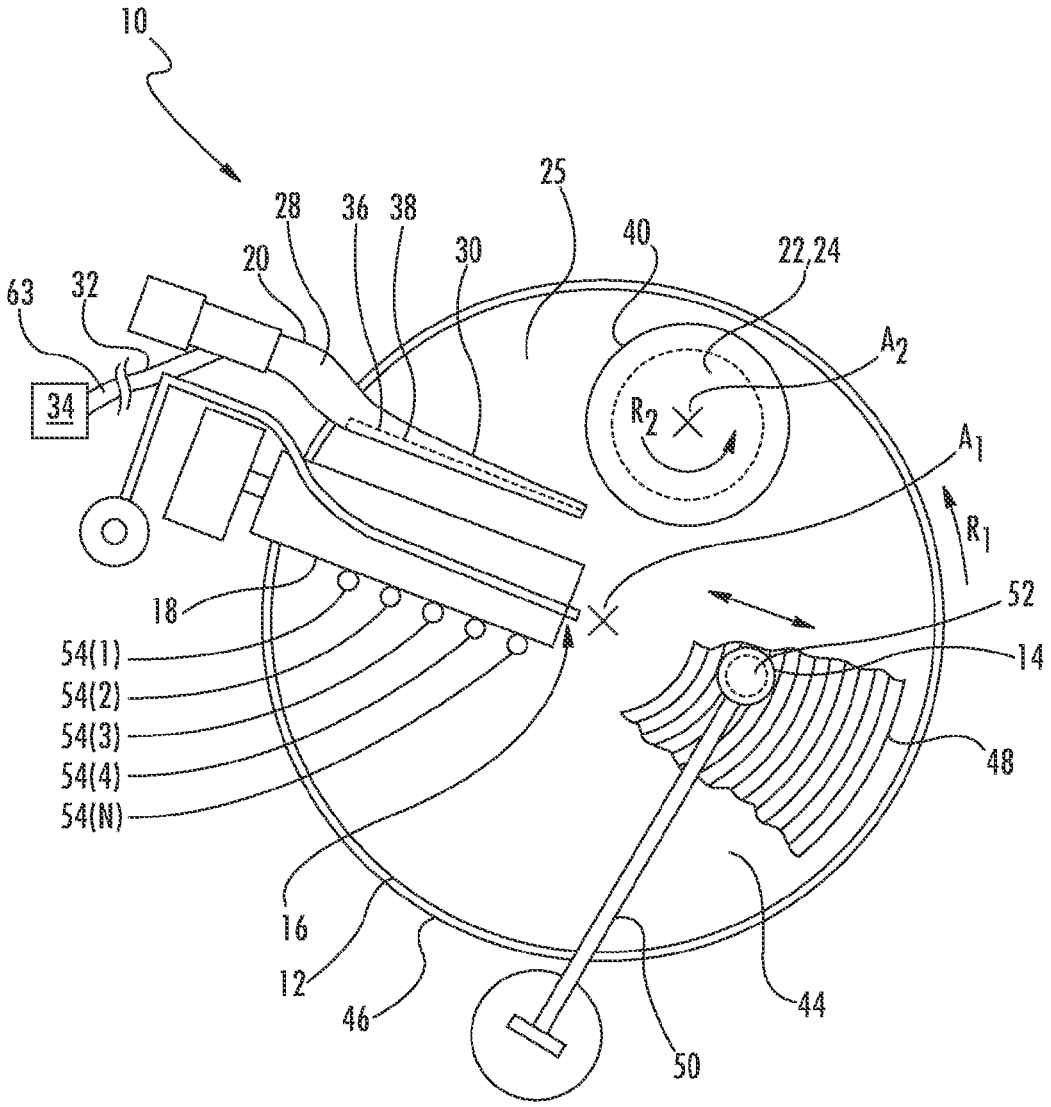

FIGS. 1A and 1B are a top perspective view and a schematic top plan view of an exemplary chemical-mechanical polishing (CMP) system 10 which includes a polishing pad 12, a conditioning head 14, a fluid dispenser 16, a rinse system 18, and a cleaning system 20. The CMP system 10 is used to planarize a process surface 22 of substrate 24 in the presence of a fluid 25, so that undesirable topography and surface defects are removed therefrom. As part of this process, debris 26 is generated and collected on the polishing pad 12. As discussed later in relation to FIG. 2A, the cleaning system 20 employs an enclosure body 28 having an inlet opening 30 and an exit opening 32. The exit opening 32 is in communication with a vacuum source 34 to create an airflow from the inlet opening 30 to the exit opening 32. The airflow may dislodge the debris 26 and the fluid 25 from the polishing pad 12 and this airflow carries the dislodged items through the enclosure body 28. The cleaning system 20 includes a containment wall 36 extending from the inlet opening to a lip 38 disposed within the enclosure body 28. In this manner, the debris 26 and the fluid 25 within the enclosure body 28 may be prevented from the containment wall 36 from returning to the polishing pad 12. Before discussing details of the cleaning system 20, the operation and other components of the CMP system 10 are now introduced to provide context as the polishing pad 12, the conditioning head 14, and the fluid dispenser 16, and the rinse system 18 are now discussed in terms of their operation as part of the CMP system 10.

In this regard, the polishing pad 12 and a polishing head 40 of the CMP system 10 may be used to planarize the process surface 22 of the substrate 24 by use of physical contact of the process surface 22 of the substrate 24 against the polishing pad 12 and by use of relative motion. The planarization removes undesired surface topography and surface defects in preparation for subsequent processes where layers of materials are sequentially deposited on and removed from the process surface 22 of the substrate 24. The substrate 24 may be, for example, a semiconductor wafer. During planarization, the substrate 24 may be mounted in the polishing head 40 and the process surface 22 of the substrate 24 is positioned by a carrier assembly 42 of the CMP system 10 to contact the polishing pad 12 of the CMP system 10. The carrier assembly 42 provides a controlled force F to the substrate 24 mounted in the polishing head 40 to urge the process surface 22 of the substrate 24 against a working surface 44 of the polishing pad 12. In this manner, contact is created between the substrate 24 and the polishing pad 12.

Removal of the undesirable topography and surface defects is also accomplished by relative rotational movement between the polishing pad 12 and the substrate 24 in the presence of a fluid 25, such as a slurry, therebetween. A platen 46 of the CMP system 10 supports the polishing pad 12 and provides rotational movement R1 to the polishing pad 12 about an axis of rotation A1. The platen 46 may be rotated by a motor in a base (not shown) of the CMP system 10. The carrier assembly 42 may also provide rotational movement R2 about an axis of rotation A2 to the substrate 24 mounted within the polishing head 40. Within the environment of this relative motion is the fluid 25. The working surface 44 of the polishing pad 12 may be generally planar, but may also include grooves 48 which may improve the performance of the polishing pad 12 by distributing the fluid 25 which is applied to the working surface 44 by use of the fluid dispenser 16. The fluid 25 may include a chemical composition, typically mixed with an abrasive, for selective removal of material from the process surface 22 of the substrate 24. The fluid dispenser 16 may dispose the fluid 25 at one or more radii of the polishing pad 12 before, during or after the relative motion. FIGS. 1A and 1B depict the fluid dispenser 16 supported by the rinse system 18, but in other embodiments (not shown) the fluid dispenser can be incorporated as part of another component or separate. The fluid 25, characteristics of the polishing pad 12, the force F, and the rotational movements R1, R2 create frictional forces and abrasive forces at the process surface 22 of the substrate 24. These frictional forces and the abrasive forces remove generate debris 26 as the undesired surface topography and surface defects are removed from the process surface 22 of the substrate 24. In this manner, the debris 26 may collect on the working surface 44 of the polishing pad 12 and in the fluid 25, and if not removed, may contaminate or scratch later-polished substrates.

The CMP system 10 includes other components to enable consistent polishing. With continued reference to FIGS. 1A and 1B, during planarization the frictional forces and abrasive forces can also cause wear to the polishing pad 12 which may necessitate periodic roughening (conditioning) to maintain the effectiveness of the polishing pad 12 and ensures consistent polishing rates. In this regard, the CMP system 10 further comprises a pivot arm 50 with the conditioning head 14 mounted to one end of the pivot arm 50, and a pad conditioner 52, such as a pad embedded with diamond crystals, mounted to the underside of the conditioning head 14. The pivot arm 50 is operatively coupled to platen 46, and maintains the pad conditioner 52 against the polishing pad 12 as the pivot arm 50 sweeps back and forth across the radius of polishing pad 12 in an arcing motion to condition the polishing pad 12. In this manner, the polishing pad 12 may be conditioned to provide consistent polishing rates.

In addition to conditioning, the polishing pad 12 is also maintained within the CMP system 10 by cleaning using the rinse system 18. Frequent cleaning of the polishing pad 12 is performed with the rinse system 18 to clean at least some of the debris 26 (polishing residue and compacted abrasives from the fluid) from the polishing pad 12. In one embodiment, this cleaning may comprise removing the substrate 24 mounted within the polishing head 40 from contact with the polishing pad 12 and turning off the supply of the fluid 25 from the fluid dispenser 16, so that a plurality of spray nozzles 54(1)-54(N) may direct fluid, for example, deionized water at the working surface 44 of the polishing pad 12. The fluid may dislodge some of the debris 26 from the polishing pad 12 for later removal, for example, by the cleaning system 20 as discussed later. In this manner, the rinse system 18 may contribute to the cleaning of the polishing pad 12.

Figure 2A:
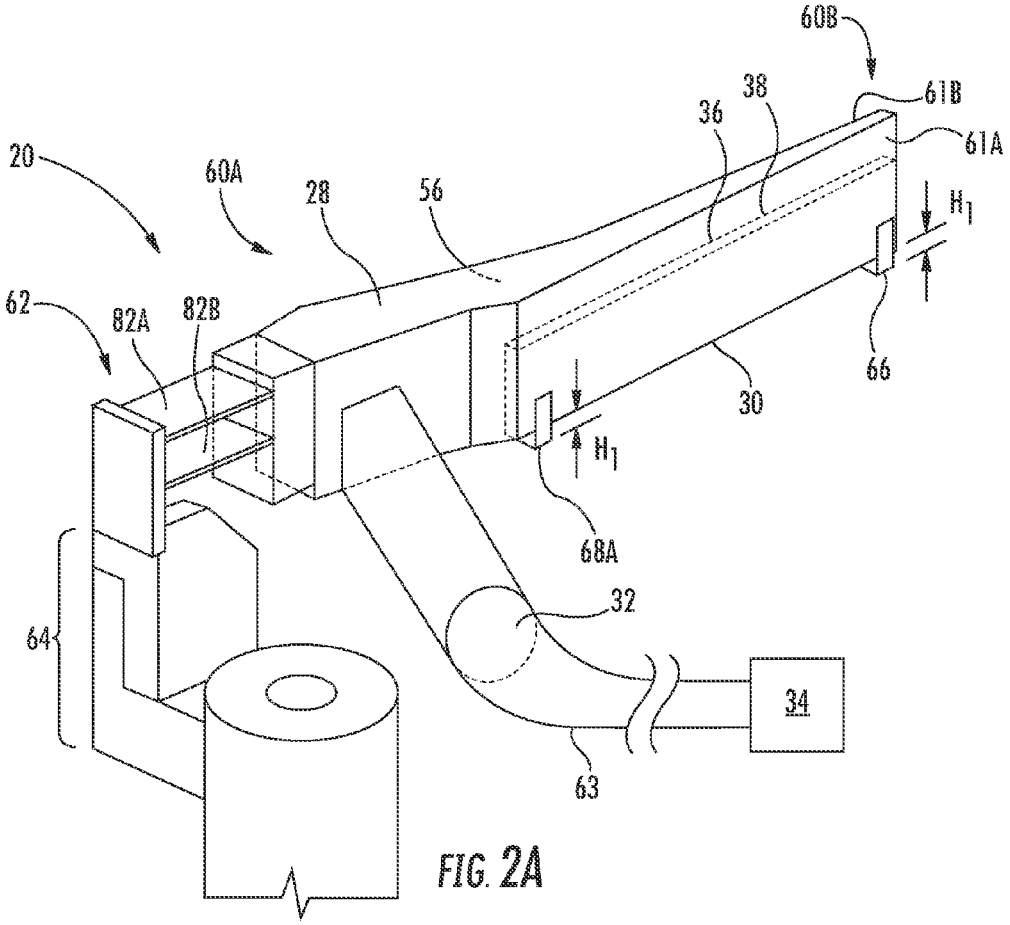
FIGS. 2A and 2B are a top perspective back view and a bottom perspective front view, respectively, of the cleaning system of FIG. 1A including an enclosure body having an inlet opening, an exit opening, and an inner volume, wherein a containment wall prevents backflow by extending from the inlet opening to a lip disposed within the inner volume.
Figure 2B:
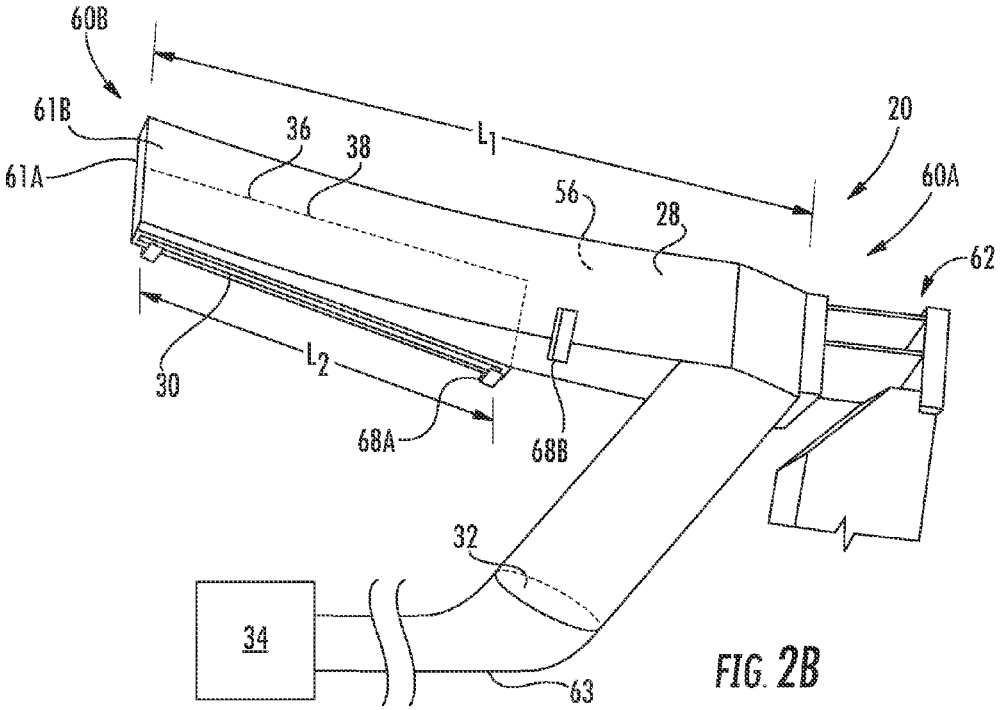

Now that the operation of the CMP system 10 has been introduced, the cleaning system 20 is now discussed in detail. In this regard, FIGS. 2A and 2B are a top perspective back view and a bottom perspective front view, respectively, of the cleaning system 20 of FIG. 1A including the enclosure body 28 having the inlet opening 30, the exit opening 32, and an inner volume 56. The cleaning system 20 includes the vacuum source 34 in communication with the exit opening 32. In this manner, the vacuum source 34 is configured to create an airflow into the inlet opening 30 and through the inner volume 56 to the exit opening 32 of the enclosure body 28. When the inlet opening 30 is disposed a predetermined distance H1 from the working surface 44 of the polishing pad 12, then the airflow may dislodge the debris 26 and the fluid 25 from the working surface 44 of the polishing pad 12. This predetermined distance H1 may be determined, for example, according to a makeup of the fluid 25, the polishing pad 12, dimensions of the enclosure body 28, and the vacuum source 34. The predetermined distance H1 may be in a range, for example, between zero (0) and ten (10) millimeters. Once dislodged, these entrained substances may be removed from the polishing pad 12 by travelling through the enclosure body 28 with the airflow to the vacuum source 34 where they may be filtered and discarded. The vacuum source 34 may be compatible with gases, fluids, and solids which may be components of the airflow, the debris 26, and/or the fluid 25. In this manner, the debris 26 and the fluid 25 may be removed from the polishing pad 12.

With continued reference to FIGS. 2A and 2B, the enclosure body 28 may extend from a first end 60A to a second end 60B opposite the first end 60A to form the inlet opening 30 and the exit opening 32, and guide the airflow and entrained substances to the exit opening 32. The enclosure body 28 may include a first longitudinal side 61A and a second longitudinal side 61B opposite the first longitudinal side 61A between the first end 60A and the second end 60B. It is noted that the enclosure body 28 may comprise a strong resilient material, for example, metal or plastic. A length L1 of the enclosure body 28 may be in a range from one-hundred (100) millimeters to eight-hundred (800) millimeters to provide sufficient structure for the inlet opening 30 and the exit opening 32. In some cases, the first end 60A of the enclosure body 28 may include the exit opening 32 and the second end 60B may include the inlet opening 30. A width L2 of the inlet opening 30 may be in a range, for example, from eighty (80) millimeters to five-hundred (500) millimeters to efficiently cover the working surface 44 of the polishing pad 12 as the polishing pad 12 rotates. In this manner, the enclosure body 28 has dimensions to remove the fluid 25 and the debris 26 to prevent contamination of later-polished substrates.

The cleaning system 20 may include components to position the inlet opening 30 to a predetermined position relative to the working surface 44 of the polishing pad 12. In this regard the cleaning system 20 may include a cleaning system mount 62 to support the enclosure body 28 at the first end of the enclosure body 28. The cleaning system mount 62 may include an actuation system 64 to move the enclosure body 28 to the predetermined position relative to the working surface 44 of the polishing pad 12. The actuation system 64 may also move the enclosure body 28 away from the polishing pad 12, for example, with a translational movement. In this manner, the enclosure body 28 may be moved away from the polishing pad 12 to support replacement of the polishing pad 12 and other maintenance and process requirements.

It is noted that a conduit 63 of the cleaning system 20 may connect the exit opening 32 to the vacuum source 34. The conduit 63 may be strong but flexible to facilitate movement of the enclosure body 28 relative to the polishing pad 12 while maintaining a connection between the enclosure body 28 and the vacuum source 34. In this regard, the conduit 63 may comprise, for example, a polymer material. The conduit may also have dimensions, for example, sufficient length to not restrict the operational range of motion of the actuation system 64. In this manner, the cleaning system 20 may move the enclosure body 28 relative to the polishing pad 12.

Other components may contribute to the positioning of the enclosure body 28 relative to the polishing pad 12. The cleaning system 20 may also include at least one first contact member 66 and at least one second contact member 68A, 68B. The first and second contact members 66, 68A, 68B may be secured to the enclosure body 28 and be configured to abut against the working surface 44 of the polishing pad 12. The first and second contact members 66, 68A, 68B may comprise an abradable material softer than the polishing pad 12, for example, plastic to avoid damage to the polishing pad 12. The first and second contact members 66, 68A, 68B may be secured to the enclosure body with, for example, a mechanical fastener, an adhesive bond, a cohesive bond, and/or thermal bond. The first and second contact members 66, 68A, 68B may have dimensions to protrude a predetermined distance H1 from the enclosure body 28 to enable the inlet opening 30 of the enclosure body 28 to be separated a distance H1 from the working surface 44 of the polishing pad 12. In this manner, a Venturi effect zone 74 (discussed later relative to FIG. 3E) may be established at the working surface 44 of the polishing pad 12 and the fluid 25 and the debris 26 may be disengaged from the polishing pad 12 and entrained within the airflow. It is also noted that the first and second contact members 66, 68A, 68B may be positioned to prevent the Venturi effect zone 74 and associated low pressure from forcing contact between various other parts of the enclosure body 28 and the polishing pad 12. By avoiding contact with the polishing pad 12, the various other parts of the enclosure body 28 may comprise harder and stronger materials which can prolong the life of the enclosure body 28 without damaging contact with the polishing pad 12.

The enclosure body 28 includes features to prevent backflow of the fluid 25 and the debris 26. FIGS. 3A through 3D are a front view, a back view, a top view, and a bottom view, respectively, of the enclosure body 28 of FIG. 1A and a portion of the cleaning system mount 62 depicting features of the inner volume 56 of the enclosure body 28. The enclosure body 28 forms the inner volume 56 which allows passage of the airflow, and the fluid 25 and the debris 26 both entrained with the airflow, from the inlet opening 30 to the exit opening 32. The portion of the enclosure body 28 at the inlet opening 30 may have a planar shape to be configured to be parallel to the working surface 44 of the polishing pad 12 and thereby establish a gap 76 of uniform dimension between the polishing pad 12 and the portion of the enclosure body around the inlet opening 30. The containment wall 36 extends from the inlet opening 30 to the lip 38 to form a first passageway 70A of constant or decreasing cross-section as travelling from the inlet opening 30 and towards the lip 38. This constant or decreasing cross-section maintains or increases a velocity of the airflow, including the fluid 25 and the debris 26 which may be entrained with the airflow. Maintaining or increasing the velocity in the first passageway 70A minimizes the opportunity for collection of the fluid 25 and the debris 26 within the first passageway 70A as kinetic energy of the fluid 25 and the debris 26 facilitates movement through the first passageway 70A and past the lip 38. Once past the lip 38, a second passageway 70B formed by the enclosure body 28 guides the airflow, including the fluid 25 and the debris 26 entrained therein, to the exit opening 32 and the conduit 63 where the fluid 25 and the debris 26 can travel to the vacuum source 34 for removal. The enclosure body 28 may form the second passageway 70B to extend downward from the lip 38 to the exit opening 32 when the enclosure body 28 is in the predetermined position to remove the fluid 25 and the debris 26 from the polishing pad 12.

It is noted that the containment wall 36 may be disposed between the first longitudinal side 61A and the second longitudinal side 61B of the enclosure body 28. The first passageway 70A of the inner volume 56 may be disposed between the first longitudinal side 61A and the containment wall 36, and the second passageway 70B of the inner volume 56 is at least partially disposed between the second longitudinal side 61B and the containment wall 36. The second passageway 70B of the inner volume 56 may taper from the first end 60A to the second end 60B of the enclosure body 28 as a space between the second longitudinal side 61B and the containment wall 36 narrows with increasing proximity to the second end 60B of the enclosure body 28. In this manner, the tapering facilitates more uniform flow from the first passageway 70A to the second passageway 70B as the amount of flow increases with increasing proximity to the first end 60A of the enclosure body 28.

Figure 3A:
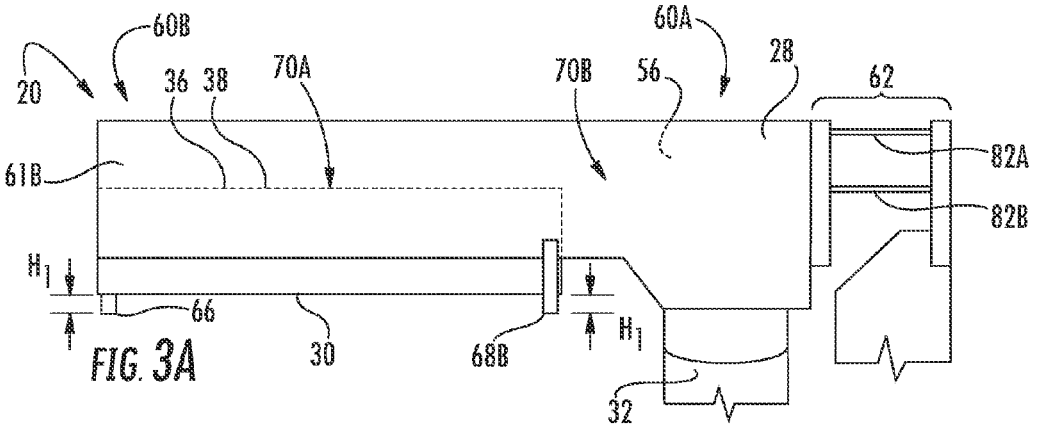
FIGS. 3A through 3D are a front view, a back view, a top view, and a bottom view, respectively, of the enclosure body of FIG. 1A and a portion of the cleaning system mount.
Figure 3B:
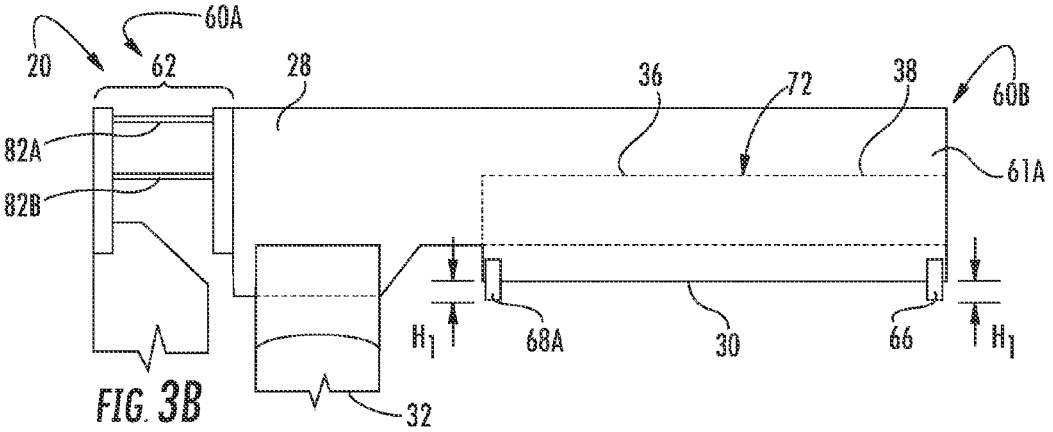
Figure 3C:
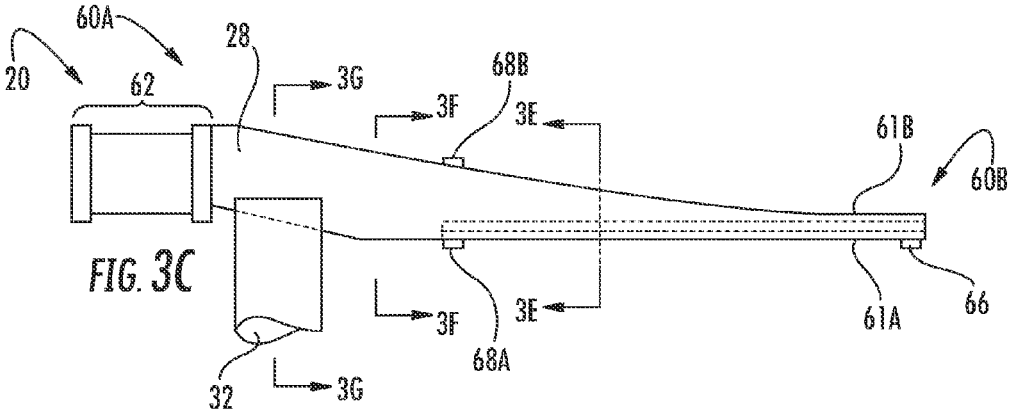
Figure 3D:
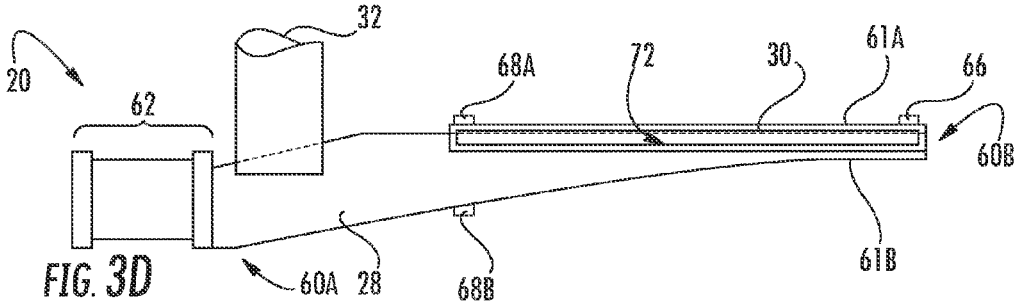
Figure 3E:
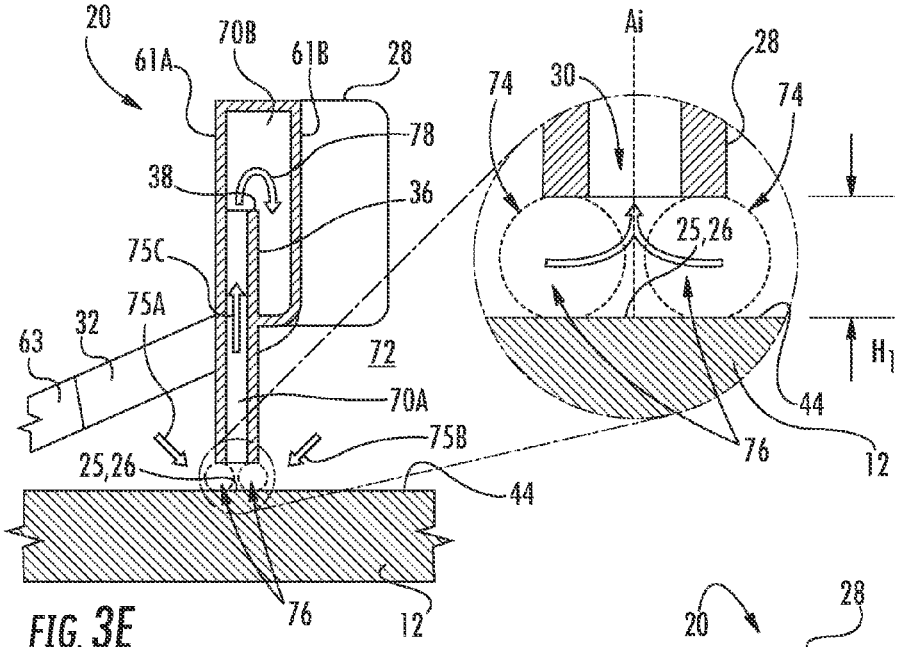
FIGS. 3E through 3G are sectional views of the enclosure body of FIG. 3C illustrating details of the inlet opening, the containment wall, and the inner volume.
Figure 3F:
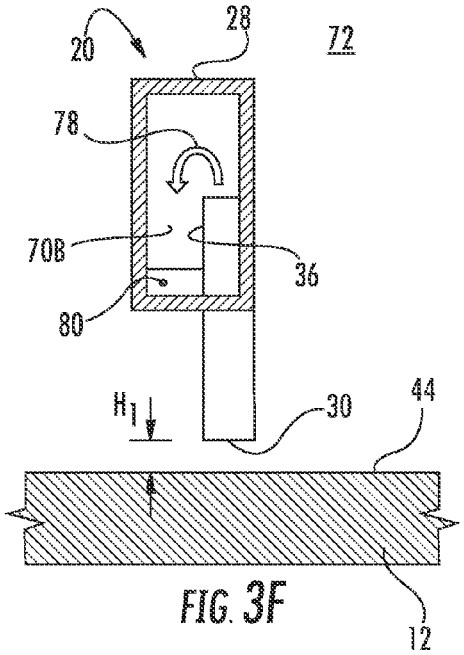
Figure 3G:
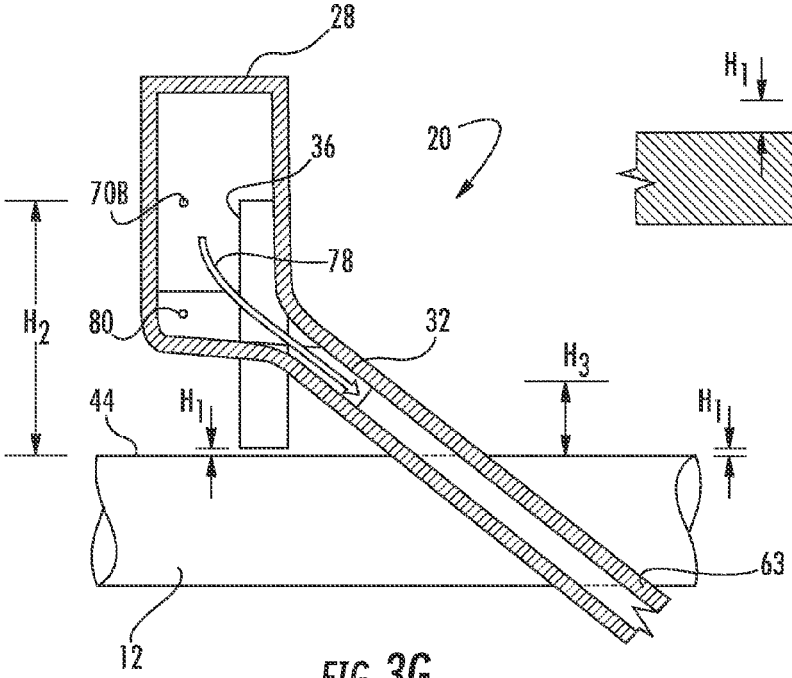

The predetermined position of the enclosure body 28 during removal of the fluid 25 and the debris 26 provides efficiency and reduces the opportunity for backflow. FIGS. 3E through 3G are sectional views of the enclosure body 28 of FIG. 3C in the predetermined position and illustrating details of the inlet opening 30, the containment wall 36, and the inner volume 56 during operation to clean the polishing pad 12. When in the predetermined position, a central axis Ai (see FIG. 3E) of the inlet opening 30 and the first passageway 70A is within ten (10) degrees of being orthogonal to the working surface 44 of the polishing pad 12 and the inlet opening 30 is within a predetermined distance H1 of the working surface 44. The first contact member 66 and the second contact members 68A, 68B are hidden from view to focus discussion on the enclosure body 28. In this regard, the vacuum source 34 is in communication with the enclosure body 28 through the exit opening 32 of the enclosure body 28. The vacuum source 34 moves, or pulls, air 72 (or other ambient gas) into the inlet opening 30, through the enclosure body 28, and from the exit opening 32. In the predetermined position depicted in FIGS. 3E through 3G, the inlet opening 30 is the predetermined distance H1 from the polishing pad 12. The predetermined distance H1 is configured to create a Venturi effect zone 74 as the air 72 (as depicted by arrows 75A, 75B in FIG. 3E) approaches a gap 76. The dimensions of the gap 76 increase the velocity or kinetic energy of the air 72 and this increased kinetic energy contributes to dislodge the fluid 25 and the debris 26 from the polishing pad 12. Once dislodged, the kinetic energy of the air 72 entrains the fluid 25 and the debris 26 in the air 72 which moves through the first passageway 70A as depicted by arrow 75C from the inlet opening 30 to the lip 38. The first passageway 70A may be formed from the enclosure body 28 and the containment wall 36 which keep the passageway cross section constant or decreasing to conserve kinetic energy as the air travels to the lip 38. Once the air 72 departs the first passageway, then the air 72 travels in a direction (depicted by arrow 78) downward towards the exit opening 32 and the conduit 63 to the vacuum source 34. In this manner, the fluid 25 and the debris 26 entrained within the air can be dislodged from the polishing pad 12 and removed, so as to not scratch later-polished substrates.

A bottom surface 80 of the passageway 70B depicted in FIGS. 3F and 3G slopes down to the exit opening 32 so that gravity may contribute to the movement of the fluid 25 and the debris 26 through the second passageway 70B to the exit opening 32. In this manner, the fluid 25 and the debris 26 may be moved to the exit opening 32 and away from the polishing pad 12. It is noted that the containment wall 36 and the lip 38 prevent the fluid 25 and the debris 26 from reentering the first passageway 70A and reaching the polishing pad 12 through the inlet opening 30. When in the predetermined position, the predetermined distance H2 of the lip 38 from the polishing pad 12 greater than the predetermined distance H1 of the inlet opening 30 from the polishing pad 12 and the predetermined distance H2 is greater than the predetermined distance H3 of the exit opening 32 from the polishing pad 12. In this regard, the exit opening 32 and the bottom portion of the second passageway 70B provide lower minimum elevations than the lip 38. Thus, since the fluid 25 and the debris 26 that may be disposed in the second passageway 70B would be at a lower elevation than the lip 38 while the enclosure body 28 is in the predetermined position, the containment wall 36 prevents the fluid 25 and the debris from crossing back over the lip 38, reentering the first passageway 70A, and returning to the polishing pad 12. A difference between the elevation of the lip 38 and the elevation associated with the exit opening 32 can large enough to prevent the fluid 25 and the debris from traveling back over the lip 38 to the first passageway 70A. In this manner, the lip and the containment wall 36 prevent backflow of the fluid 25 and the debris 26 to the polishing pad 12.

The relative position of the enclosure body 28 of the cleaning system 20 to the polishing pad 12 facilitates the fluid 25 and the debris 26 entrained within the air 72 to be dislodged from the polishing pad 12 and be removed from the polishing pad 12 through the enclosure body 28. Specifically, the enclosure body 28 may be positioned, so that the central axes Ai of the first passageway 70A may be orthogonal or substantially orthogonal to the working surface 44 of the polishing pad 12 and the inlet opening 30 is the predetermined distance H1 from the polishing pad 12. In order to precisely position the enclosure body 28 relative to the polishing pad 12, the cleaning system 20 may include the cleaning system mount 62 to position and support the enclosure body 28 by creating an abutment with the polishing pad 12.

Figure 4A:
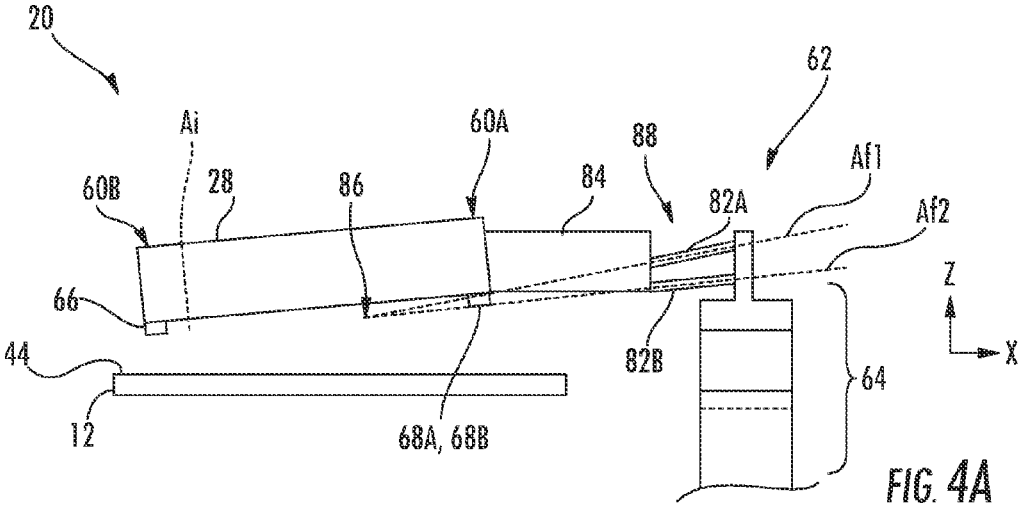
Figure 4B:
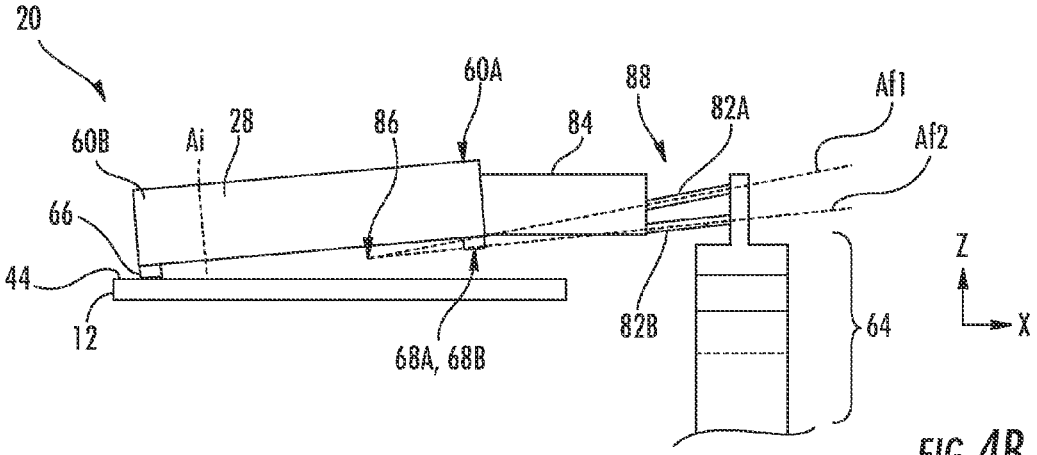
Figure 4C:
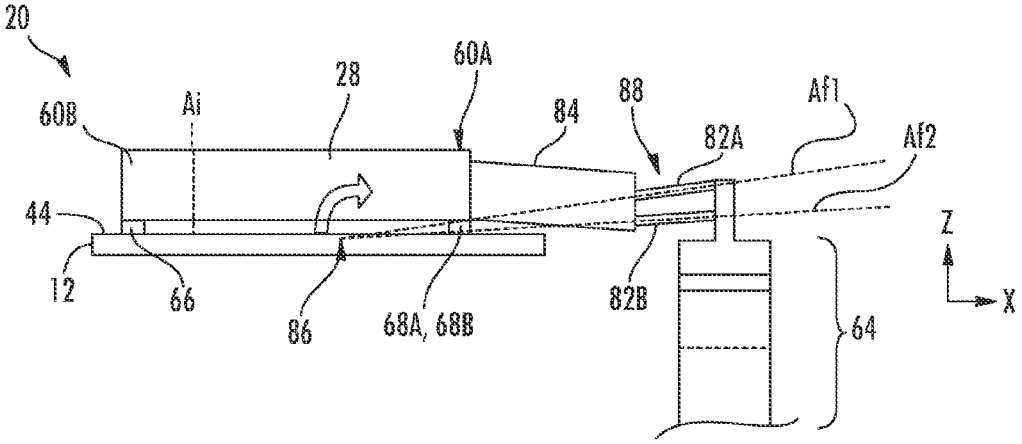

In this regard, FIG. 4A through 4C are schematic views of an abutment being created between the polishing pad 12 and the first contact member 66 and the second contact members 68A, 68B. The cleaning system mount 62 may include the actuation system 64; flexures 82A, 82B; and a connection member 84. The actuation system 64 may provide changes in an elevation (z-direction) of the enclosure body 28. The connection member 84 may be attached to the enclosure body 28 and may provide attachment locations for the flexures 82A, 82B. The flexures 82A, 82B are arranged to be non-parallel in a multi-flexure linkage arrangement, so that they are aligned with flexure axes Af1, Af2 which converge at a virtual pivot point 86 disposed between the first contact member 66 and the second contact members 68A, 68B. Collectively, the flexures 82A, 82B; the connection member 84; and the actuation system 64 form a four-bar linkage 88 which enables the first contact member 66 to abut against the polishing pad 12 prior to the second contact members 68A, 68B. Establishing an abutment with the first contact member 66 is generally more difficult and unsuccessful abutments are believed to cause some undesirable positioning of the enclosure body 28 relative to the polishing pad 12. Thus, by establishing the abutment initially at the first contact member 66, the predetermined position of the enclosure body 28 be more easily and reliably achieved.

This abutment approach may be most easily observed in a series of chronological drawings depicting this approach. FIG. 4A depicts the actuation system 64 lowering the first contact member 66 and enclosure body 28 towards the working surface 44 of the polishing pad 12. FIG. 4B depicts actuation system 64 continuing to lower the enclosure body 28 as the first contact member 66 achieves initial abutment with the working surface 44. FIG. 4C depicts the enclosure body 28 lowered further in comparison to FIG. 4B by use of the actuation system 64, wherein the enclosure body 28 rotates about the virtual pivot point 86 until the second contact members 68A, 68B also form an abutment with the polishing pad 12. In this manner, the predetermined position of the enclosure body 28 relative to the working surface 44 of the polishing pad 12 is achieved.

Figure 5:
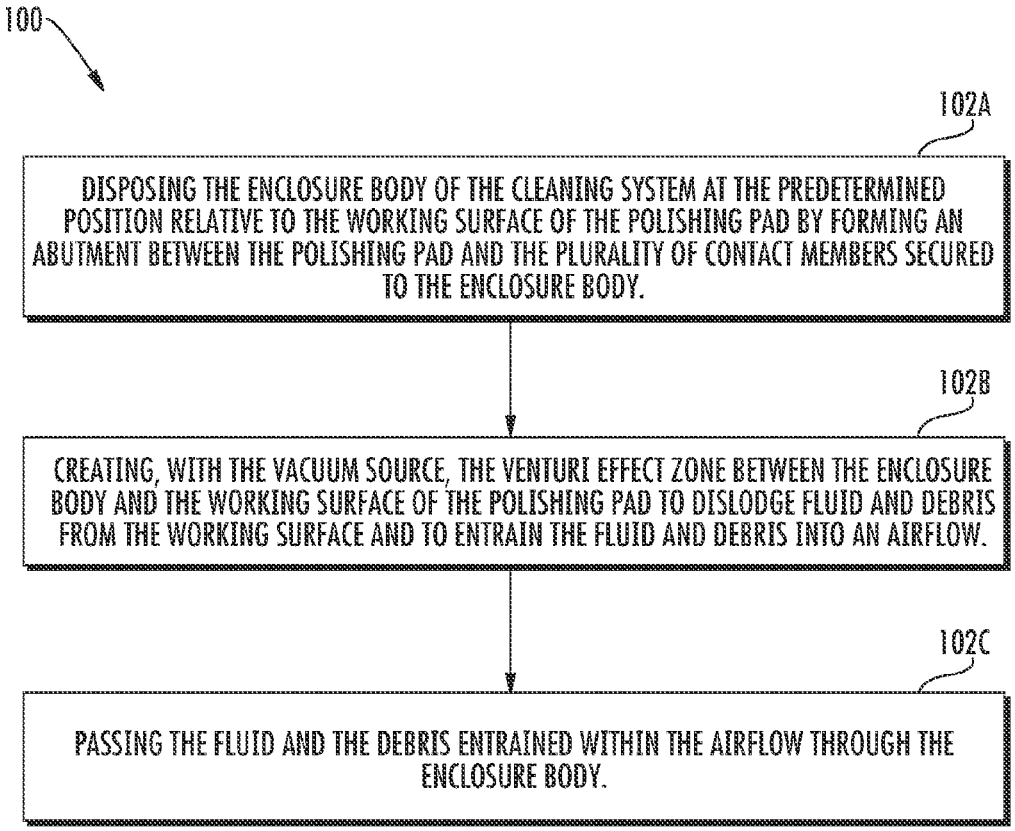
FIG. 5 is a flowchart of an exemplary method to remove debris from the polishing pad.

FIG. 5 is a flow chart of an exemplary method 100 to remove the fluid 25 and the debris 26 from the polishing pad 12. The method 100 is now discussed using the terminology discussed above in relation to the operations 102A-102D as represented in FIG. 5. In this regard, the method 100 may include disposing the enclosure body 28 of the cleaning system 20 at the predetermined position relative to the working surface 44 of a polishing pad 12 by forming an abutment between the polishing pad 12 and the plurality of contact members 66, 68A, 68B secured to the enclosure body 28 (operation 102A of FIG. 5). The enclosure body 28 includes the inlet opening 30, the exit opening 32, and the inner volume 56. The containment wall 36 may be disposed within the enclosure body 28 and may extend away from the inlet opening 30 to the lip 38 within the enclosure body 28. The lip 38 separates the first passageway 70A of the inner volume 56 extending from the inlet opening 30 from the second passageway 70B of the inner volume 56. The second passageway 70B may be positioned to enable gravity to move the fluid 25 and the debris 26 to be disposed therein to the exit opening 32. The exit opening 32 is in communication with the vacuum source 34. Thus, amounts of the fluid 25 and the debris 26 that may be brought into the inner volume 56 may be removed through the enclosure body 28 and out through the exit opening 32 to the vacuum source 34. In this manner, the enclosure body 28 is readied for cleaning the polishing pad 12. The method 100 may also include creating, with the vacuum source 34, the Venturi effect zone 74 between the enclosure body 28 and the working surface 44 of the polishing pad 12 (operation 102B of FIG. 5). Airflow in the Venturi effect zone 74 dislodges the fluid 25 and the debris 26 from the working surface 44 and entrains the fluid 25 and the debris 26 into the airflow and through the enclosure body 28. In this manner, the fluid 25 and the debris 26 may be dislodged from the polishing pad 12.

The method 100 also includes passing the fluid 25 and the debris 26 entrained within the airflow through the enclosure body 28 (operation 102C of FIG. 5). The fluid 25 and the debris 26 may pass from the inlet opening 30 of the enclosure body 28 to the exit opening 32 of the enclosure body 28. The lip 38 and the containment wall 36 prevents backflow of the fluid 25 and the debris 26 to the polishing pad 12. In this manner, the debris 26 may be removed from the manufacturing area to prevent contamination.

Many modifications and other embodiments not set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

While the foregoing is directed to embodiments of the present disclosure, other and further embodiments of the disclosure may be devised without departing from the basic scope thereof, and the scope thereof is determined by the claims that follow.

What is claimed is:

1. A cleaning system for a polishing pad, the cleaning system comprising:

an enclosure body including an inlet opening, an exit opening, and an inner volume;

a plurality of contact members secured to the enclosure body and configured to form an abutment against a working surface of the polishing pad, and configured to position the enclosure body a predetermined distance from the working surface of the polishing pad;

a vacuum source in communication with the exit opening of the enclosure body to move fluid and debris entrained within air through the enclosure body; and a containment wall disposed within the enclosure body and extending away from the inlet opening to a lip disposed within the enclosure body.

2. The cleaning system of claim 1, wherein the lip separates a first passageway from a second passageway of the inner volume, the first passageway extends from the inlet opening to the lip, and the containment wall is arranged to prevent passage of the fluid and the debris from the second passageway to the first passageway.

3. The cleaning system of claim 1, further comprising a cleaning system mount which supports the enclosure body at a first end of the enclosure body, wherein the enclosure body extends from the first end to a second end of the enclosure body opposite the first end.

4. The cleaning system of claim 2, wherein the containment wall is disposed between a first longitudinal side and a second longitudinal side of the enclosure body, wherein the first passageway of the inner volume is disposed between the first longitudinal side and the containment wall, and the second passageway of the inner volume is at least partially disposed between the second longitudinal side and the containment wall.

5. The cleaning system of claim 4, wherein the second passageway of the inner volume tapers from a first end to a second end of the enclosure body as a space between the second longitudinal side and the containment wall narrows with increasing proximity to the second end of the enclosure body.

6. The cleaning system of claim 2, wherein the inlet opening, the lip, and the exit opening are configured to be positioned at predetermined distances from a working surface of the polishing pad while the cleaning system removes debris from the working surface of the polishing pad, and the predetermined distance associated with the lip is greater than the predetermined distance associated with the inlet opening and the predetermined distance associated with the exit opening.

7. The cleaning system of claim 6, wherein the second passageway of the inner volume is positioned to enable gravity to facilitate movement of fluid disposed therein during polishing to the exit opening.

8. The cleaning system of claim 3, wherein the cleaning system mount comprises an actuation system which is arranged to provide relative translational movement between the polishing pad and the enclosure body.

9. The cleaning system of claim 8, wherein the cleaning system mount further includes a multi-flexure linkage to provide a virtual pivot point disposed between a first one of the plurality of contact members secured to the first end of the enclosure body and a second one of the plurality of contact members secured to the second end of the enclosure body.

10. The cleaning system of claim 2, wherein the first passageway has a uniform cross-section from the inlet opening to the lip.

11. A method for cleaning a polishing pad, comprising:

disposing an enclosure body of a cleaning system at a predetermined position relative to a working surface of a polishing pad by forming an abutment between the polishing pad and a plurality of contact members secured to the enclosure body, the enclosure body including an inlet opening, an exit opening, an inner volume, and a containment wall disposed within the enclosure body and extending away from the inlet opening to a lip disposed within the enclosure body;

creating, with a vacuum source, a Venturi effect zone between the enclosure body and the working surface of the polishing pad to dislodge fluid and debris from the working surface and to entrain the fluid and the debris into an airflow; and passing the fluid and the debris entrained within the airflow through the enclosure body.

12. The method of claim 11, wherein the lip separates a first passageway from a second passageway of the inner volume, the first passageway extends from the inlet opening to the lip, and the containment wall and the lip prevent backflow of fluid and debris from the second passageway to the first passageway of the inner volume.

13. The method of claim 11, further comprising supporting, with a cleaning system mount, the enclosure body at a first end of the enclosure body, wherein the enclosure body extends from the first end to a second end of the enclosure body opposite the first end.

14. The method of claim 12, wherein the disposing the enclosure body includes positioning the inlet opening, the lip, and the exit opening at predetermined distances from the working surface of the polishing pad, and the predetermined distance associated with the lip is greater than the predetermined distance associated with the inlet opening and the predetermined distance associated with the exit opening.

15. The method of claim 12, wherein the disposing the enclosure body includes positioning the second passageway of the inner volume to enable gravity to move the fluid and debris disposed therein to the exit opening.

16. The method of claim 13, further wherein the disposing the enclosure body comprises providing relative movement between the polishing pad and the enclosure body.

17. The method of claim 16, further wherein the disposing the enclosure body comprises providing a virtual pivot point disposed between a first one of a plurality of contact members secured to the first end of the enclosure body and a second one of the plurality of contact members secured to a second end of the enclosure body.

18. A chemical-mechanical polishing (CMP) system, comprising:

a polishing pad secured to a rotatable platen;

a polishing head arranged to position a surface of a substrate against the polishing pad;

a cleaning system for the polishing pad, the cleaning system comprising:

an enclosure body including an inlet opening, an exit opening, and an inner volume;

a plurality of contact members secured to the enclosure body and configured to form an abutment against a working surface of the polishing pad, and configured to position the inlet opening a predetermined distance from the working surface of the polishing pad;

a vacuum source in communication with the exit opening of the enclosure body to move fluid and debris entrained within air through the enclosure body; and a containment wall disposed within the enclosure body and extending away from the inlet opening to a lip disposed within the enclosure body.

19. The CMP system of claim 18, wherein the lip separates a first passageway from a second passageway of the inner volume, wherein first passageway extends from the inlet opening to the lip.

20. The CMP system of claim 18, wherein the lip separates a first passageway from a second passageway of the inner volume, the first passageway extends from the inlet opening to the lip, and the containment wall is arranged to prevent passage of the fluid and the debris from the second passageway to the first passageway.

* * * * *